US005935015A

United States Patent [19]

Spiegel

[11] Patent Number: 5,935,015

[45] Date of Patent: Aug. 10, 1999

[54] GOLF PUTTER

[76] Inventor: Alvan D. Spiegel, 10 Hidden Acre La., Hickory, Pa. 15340

[21] Appl. No.: 09/044,738

[22] Filed: Mar. 19, 1998

[51] Int. Cl.[6] ..... A63B 69/36; G01B 13/00

[52] U.S. Cl. ..... 473/226; 473/241; 33/508

[58] Field of Search ..... 473/219, 226, 473/231, 238, 241, 257, 261, 282; 33/334, 377, 384, 396, 508

[56] References Cited

U.S. PATENT DOCUMENTS

| | | |
|---|---|---|
| 2,995,375 | 8/1961 | Bukovey . |
| 3,306,618 | 2/1967 | Liljequist . |
| 4,082,286 | 4/1978 | La Breche . |
| 4,135,720 | 1/1979 | Lancellotti . |
| 4,194,739 | 3/1980 | Thompson . |
| 5,160,142 | 11/1992 | Marshall . |
| 5,195,747 | 3/1993 | Choy . |
| 5,219,169 | 6/1993 | Martini . |
| 5,492,329 | 2/1996 | Kronin . |
| 5,613,916 | 3/1997 | Sommer . |

*Primary Examiner*—Sebastiano Passaniti
*Attorney, Agent, or Firm*—J. Stewart Brams

[57] ABSTRACT

The present invention contemplates an improved indicator for use in combination with a golf putter to provide improved putting performance by giving the golfer a point of focus on which to concentrate during putting, and by indicating whether the putting stroke is on or off line. The indicator includes a fluid filled container with a transparent face, and a ball or similar element movably disposed in the container. The container is fixed atop or adjacent to a putter head in a manner that a center line therein, which is visible through the transparent face of the container, is centered with respect to the putter head and extends at a right angle to the putter face.

17 Claims, 2 Drawing Sheets

12
10
28
30
26
16
20
22
21
18
24

10
12
40
22
28
30
26
18
21
20
24
18

GOLF PUTTER

BACKGROUND OF THE INVENTION

In the game of golf, a variety of clubs including drivers, irons and putters are used. Putting in particular is a most demanding aspect of the game, and a wide variety of putter designs have been proposed to enhance putting performance.

For example, U.S. Pat. No. 5,160,142 discloses a putting training device with a housing for a ball and a plurality of angularly disposed pockets into which the ball can roll during the putting stroke. U.S. Pat. No. 4,135,720 discloses another such device. U.S. Pat. No. 4,194,739 discloses an adjustable putter. U.S. Pat. No. 5,219,169 discloses a golf club with a bubble indicator. U.S. Pat. No. 4,082,286 discloses another golf club with bubble indicator. U.S. Pat. No. 5,195,747 discloses a golf club with weights which are movable to maintain the center of inertia in the same location regardless of club swing plane. U.S. Pat. No. 5,613,916 discloses a golf club with mass elements which are movable to attenuate shock and vibration. U.S. Pat. No. 5,492,329 discloses a golf putter with an LED leveling device.

Notwithstanding the many attempts to design a putter that offers the prospect of significantly improved performance, golfers continue to seek ways to enhance their performance and improve their scores. Putting is said to be the most crucial aspect of the game. That is, while the shots from the tee to the green require skill and accuracy, they also require power. Improvements in driving accuracy are not likely to improve a golfer's scores in the absence of distance improvements. In putting, by contrast, the possibility of score improvements resides entirely in improvements in skill, accuracy and technique. Moreover, a large majority of the shots taken by golfers are putts. Accordingly, golfers have long sought ways to improve their putting as the only feasible means of improving their scores.

One of the key difficulties in putting is development of a consistent, uniform stroke. It is very important in this respect for the golfer to keep the head down and the eyes on the ball. A common failing is the propensity to focus on the hole or the anticipated path of the ball as it travels toward the hole. Thus, a golfer may often raise the eyes toward the hole before the putting stroke is complete, and in the process will move the shoulders and throw the stroke off line.

An indicator on the club which requires the golfer's attention throughout the putting stroke will encourage the golfer to keep the head down and the focus of attention where it should be. An indicator can also serve the purpose of indicating to the golfer whether the putting stroke is on or off line.

BRIEF SUMMARY OF THE INVENTION

The present invention contemplates a novel and improved indicator for use in combination with a novel golf putter to provide improved putting performance by giving the golfer a point of focus on which to concentrate during putting, and by indicating whether the putting stroke is on or off line. The indicator includes a fluid filled container with a transparent face, and a ball or similar element movably disposed in the container. The container is fixed atop or adjacent to a putter head in a manner that a center line therein, which is visible through the transparent face of the container, is centered with respect to the putter head and extends at a right angle to the putter face.

The ball can be positioned on the center line, and is to be maintained on the center line throughout the putting stroke.

This encourages improved putting in two ways. First, the golfer must focus on the indicator to observe the motion of the ball, and is thus encouraged to keep the head and eyes down. Moreover, the focus and attention required to observe the indicator cues is in itself instrumental in imposing proper form on the golfer and thereby eliminating stroke flaws. Second, the golfer must maintain a uniform, correct putting stroke in order to keep the ball on the center line throughout the stroke. Movement of the ball is controlled by the damping effect of the fluid medium that fills the container. The resulting relatively slow movement of the ball during the putting stroke is easy for the golfer to visually follow. This reduces or eliminates any disturbance of the putt resulting from the golfer's efforts to follow the movement of the ball during the putting stroke.

The invention achieves these objectives, among others. It is therefore one object of the invention to provide a novel and improved golf putter.

Another object of the invention is to provide a golf putter with a novel and improved indicator that encourages improved putting technique.

A more specific object of the invention is to provide a golf putter with an indicator including a fluid filled container with a transparent face, and within which container a movable element is disposed for free movement within the contained fluid in response to the putting stroke, to thereby indicate whether the putting stroke is on line.

These and other objects and further advantages of the invention will be more readily understood upon consideration of the following detailed description, and the accompanying drawings, in which.

Figure 1:
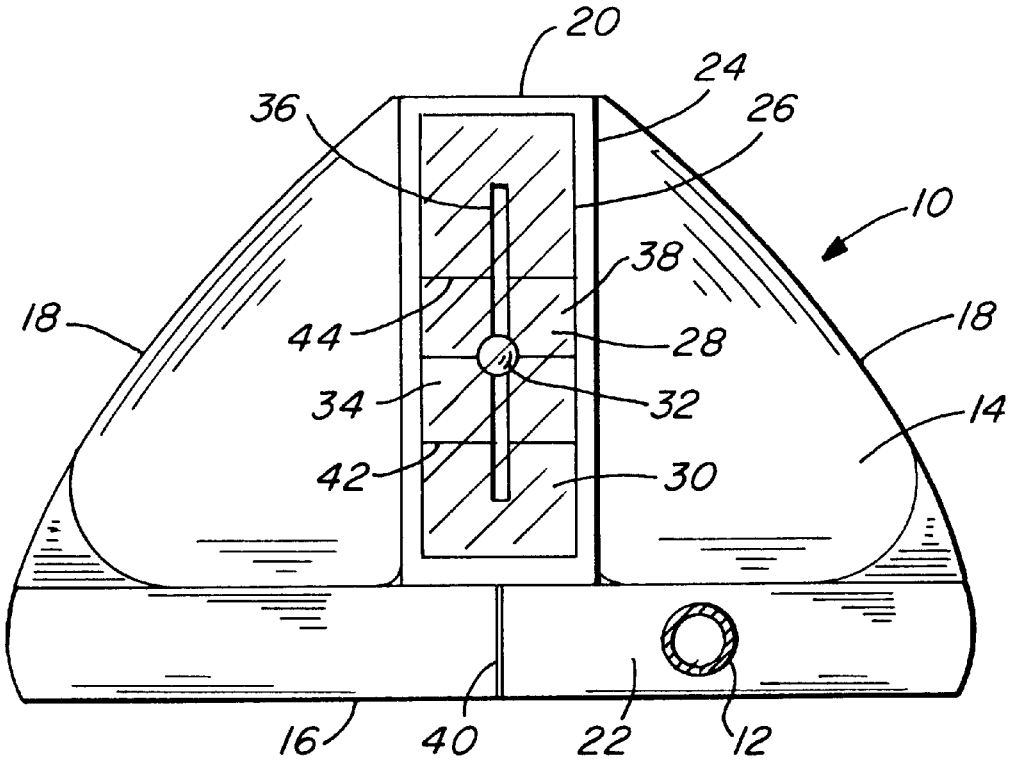
FIG. 1 is a top plan view of a putter head according to one presently preferred embodiment of the invention.
Figure 2:
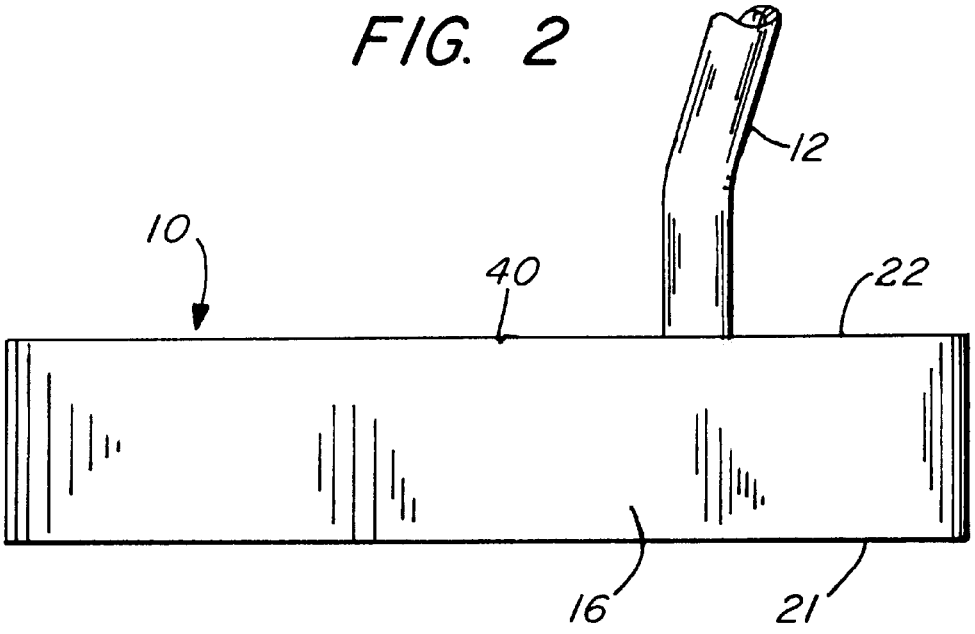
FIG. 2 is a front elevation of the invention.
Figure 3:
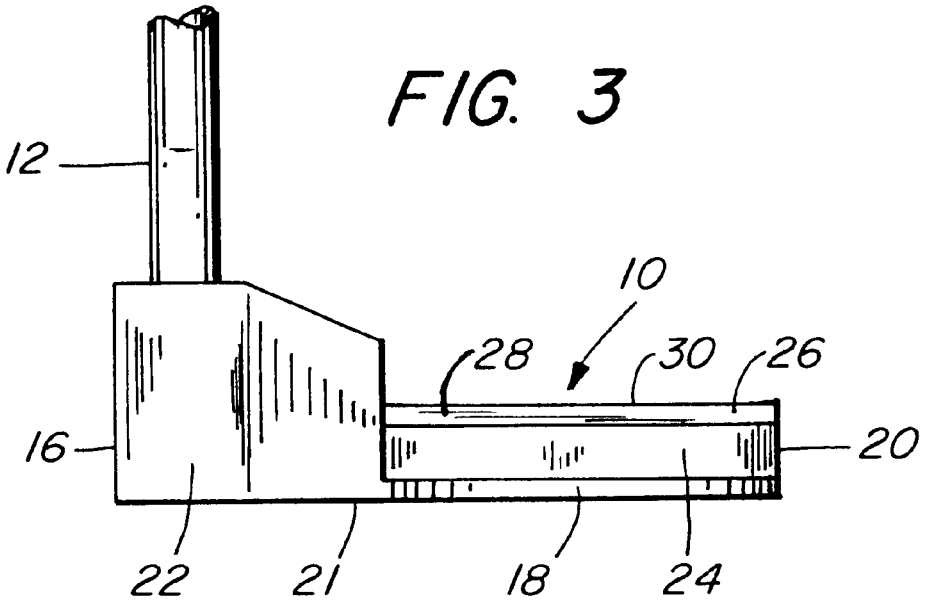
FIG. 3 is a side elevation of the invention.

There is generally indicated at 10 in FIGS. 1 to 4 a putter head according to one presently preferred embodiment of the instant invention. Putter head 10 is mounted at the lower end of a shaft 12 of conventional construction and comprises a rigid, preferably unitary body 14 which may be made by the conventional methods for making golf putter heads. Body 14 includes a frontal portion 22 with a ball striking face 16 and tapering side flanks 18 which converge toward a rear portion 20. The resulting V-shape of the putter head, as shown in FIG. 1, improves the ease with which the golfer can align the putter head to the ball and the desired path of the putting stroke.

Figure 4:
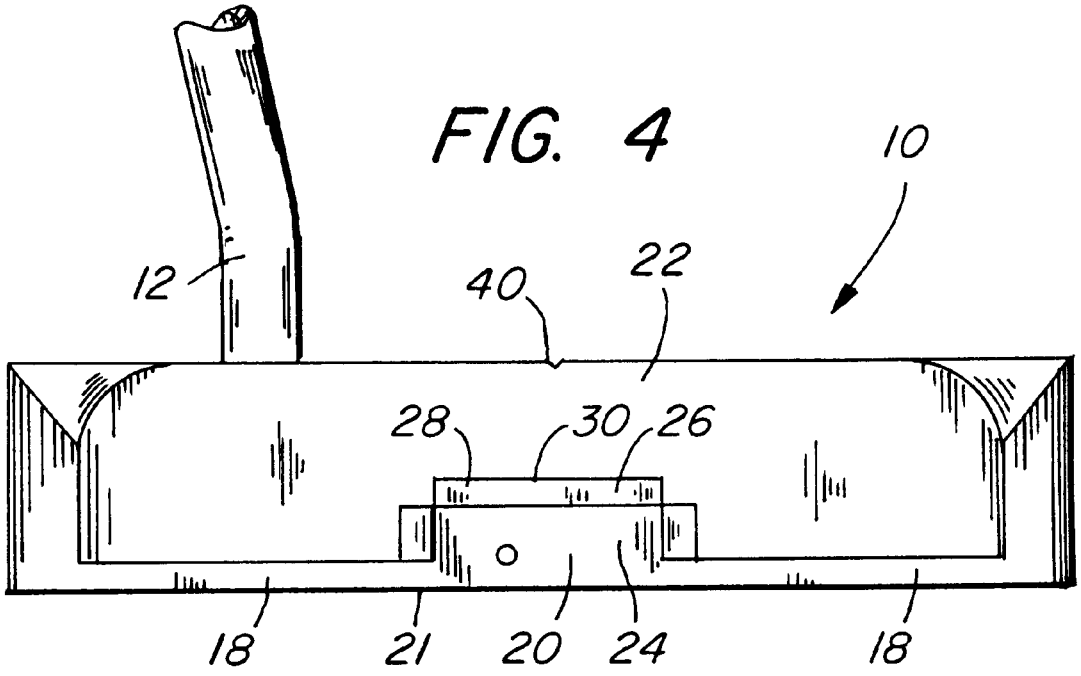
FIG. 4 is a rear elevation of the invention.

As shown in FIG. 4, flanks 18 are of relatively thin vertical section thickness compared to the frontal portion 22 of body 14. The overall bottom surface area 21 encompassed within the bounds of face 16, flanks 18 and portion 20 provides an enlarged base which, by merely placing the putter head flat on the ground, allows the putter to be easily balanced and aligned with the ground surface. This feature also helps the golfer line up the putter with the ball and the desired path of the putting stroke.

An elongated indicator mounting portion 24 of body 14 extends centrally of body 14 from frontal portion 22 generally perpendicular to face 16, and is structured to receive and retain an indicator assembly 26. The indicator 26 comprises an elongated, sealed container 28 of molded plastic for example, the container having an upwardly facing, transparent surface area 30 through which the golfer may observe the interior of container 28. A movable element 32, a spherical ball element such as a steel ball bearing for example, is movably disposed within the container 28 and visible through area 30. Container 28 is completely filled with a fluid medium 34 of suitable viscosity to damp and thereby control movement of ball element 32. The ball element 32 is otherwise freely movable within container 28, subject to the limitations on its movement imposed by the fluid medium viscosity.

Differing characteristics of ball element movement may be achieved to provide the most beneficial indicator performance for different golfers by selection of fluid media of differing viscosities. The fluid medium used preferably should exhibit a relatively uniform viscosity throughout the range of temperature conditions a golfer will typically encounter under all playing conditions. This will allow the indicator to give more consistent readings.

Of course, fluid medium 34 must not obscure the ball element 32 since visual observation of ball movement is required for effective use of the invention. Preferably, the fluid medium 34 may be a clear or transparent fluid, a refrigerant oil for example, and ball element 32 may be a ball bearing with a bright finish. Other combinations of fluid color and transparency, and ball element finish or color, are possible so long as the requisite visibility of the ball element in the fluid is maintained. Further, various combinations of ball material and size, and therefore its mass, and fluid viscosity are also possible, consistent with the desired properties of ball movement.

Container 28 is oriented with its longitudinal dimension extending along body portion 24 away from face 16. An elongated groove 36 extends in a base wall or floor portion 38 of container 28 perpendicular to face 16 and is visible through transparent surface 30. When the indicator assembly is mounted on putter body 14, groove 36 preferably forms an extension of a putter head center line 40 scribed at a laterally central location on body portion 22 and extending perpendicular to face 16.

Groove 36 provides a depression within which ball element 32 may rest by gravity to move longitudinally of the indicator 26. For example, a groove width of approximately 1/32 in. may be suitable for a 1/4 in. diameter ball element, although of course other groove widths and ball diameters may be used. Thus, while groove 36 can guide ball 32 longitudinally of the indicator in response to putter movement during the stroke, it does not significantly restrain the ball against lateral movement.

If the golfer executes a flawed putting stroke in which the putter is pulled off line by faulty technique, the ball 32, being essentially unrestrained against lateral movement, will move laterally to one side or the other of groove 36 and thereby visually indicate to the golfer the nature of the stroke flaw. In general, relative movement of ball 32 to one side of groove 36 indicates that the stroke was off line to the opposite side. Moreover, by focusing on the ball continuously throughout the stroke, the golfer can visually ascertain the exact point in the stroke where the problem occurs by observing when the ball 32 begins to move laterally off of groove 36. The cues provided by the described indicator thus offer specific indication of both the nature of the stroke flaw and the point in the stroke where the flaw occurs.

In addition to groove 36, transverse scribe or marker lines 42 and 44 extending at right angles to groove 36 may be provided on container base portion 38. The scribe lines 42 and 44 may be located to indicate preferred limits of ball movement along groove 36 during the putting stroke, although the scribe lines preferably do not limit ball movement in any way.

In view of the above description, use and operation of the invention may be readily understood. A golfer approaches the golf ball on the green and assumes the proper position to execute the putt, aligning the putter in the process with both the golf ball and its intended path of travel. The golfer must also position the indicator ball 32 in container 28 by appropriately tilting and otherwise manipulating the putter. Preferably, when the golfer is ready to execute the putt, indicator ball 32 will be positioned on groove 36 midway between scribe lines 42 and 44, as shown in FIG. 1

Practice strokes, which may be taken either before or after positioning oneself to execute a putt, permit the golfer to visually track the stroke by observation of the indicator ball movement. The attention necessary to follow the indicator ball movement requires the golfer to keep the head down with eyes focused on the club movement throughout the stroke.

To execute the putt, the golfer strokes the golf ball with head down and attention focused on the ball indicator, just as done in practice strokes. The cues afforded by the indicator ball movement will, over time, allow the golfer to cultivate an improved and more effective putting technique, the result of which can be improved putting performance and scores.

In executing an actual putt, of course, by the time the golfer observes incorrect indicator ball movement it is too late to correct the adverse effect of the flawed putting stroke on the travel of the golf ball; however, the indicator ball movement indicating a flawed stroke, together with the readily observed effect on the golf ball travel, provides further cues that can aid in development of improved putting technique over time.

According to the description hereinabove, the present invention provides a novel and improved indicator, and such an indicator in combination with a golf putter, to permit direct observation of putting stroke flaws as they occur, thereby allowing the golfer to use the indicator cues to eliminate the stroke flaws and improve putting technique. Moreover, the focus and attention required to observe the indicator cues is in itself instrumental in imposing proper form on the golfer and thereby eliminating stroke flaws. Notwithstanding the description here of certain presently preferred embodiments of the invention, various alternative and modified embodiments are contemplated, and certainly such would also occur to others versed in the art once they were apprised of my invention. I therefore intend that the invention should be construed broadly and limited only by the scope of the claims appended hereto.

I claim:

1. An indicator apparatus adapted to be carried by a golf putter comprising:

a container adapted to be carried by a golf putter head;

said container having an interior space with an interior wall portion, and a transparent surface area through which said interior wall portion is visible;

said interior wall portion having elongated means defined thereon to be visible through said transparent surface;

a fluid medium contained within said interior space;

movable indicator means disposed within said interior space and being movable therein in said fluid medium;

said fluid medium being of a character that said interior wall portion of said interior space and said movable indicator means are visible therethrough when viewed through said transparent surface area; and said elongated means being cooperable with said movable indicator means to guide said movable indicator means longitudinally thereof substantially without restraining said movable indicator means against movement laterally thereof, whereby movement of said movable indicator means with respect to said elongated means assists a golfer in lining up a golf putter with both a golf ball and a desired path during a putting stroke.

2. The indicator apparatus as set forth in claim 1 wherein said elongated means includes elongated groove means formed in said base portion.

3. The indicator apparatus as set forth in claim 2 wherein said movable indicator means is a spherical ball.

4. The indicator apparatus as set forth in claim 3 wherein said groove means is a groove of approximately 1/32 in. maximum width.

5. The indicator apparatus as set forth in claim 4 wherein said spherical ball is a ball of approximately ¼ in. diameter.

6. The indicator apparatus as set forth in claim 1 additionally including transverse marker means extending on said base portion transversely of said elongated means.

7. The indicator apparatus as set forth in claim 1 wherein said interior wall portion is an upwardly facing wall and said movable indicator means is gravitationally supportable thereon.

8. The indicator apparatus as set forth in claim 1 wherein said elongated means is cooperable with said movable indicator means by gravitational interaction therebetween to guide said movable indicator means longitudinally thereof substantially without restraining said movable indicator means against movement laterally thereof.

9. The indicator apparatus as set forth in claim 1 additionally including mounting means for mounting said apparatus on a golf putter with said base wall facing upwardly and said elongated means extending generally perpendicular to the ball striking face of such a golf putter.

10. In a golf putter apparatus, the combination comprising:

a putter club having an elongated shaft and a head portion fixed to said shaft adjacent its lower end;

said head portion having a ball striking surface;

an indicator assembly carried by said golf putter;

said indicator assembly comprising a container having an interior space with an interior wall portion, and a transparent surface area through which said interior wall portion is visible;

said interior wall portion having elongated means defined thereon to be visible through said transparent surface;

a fluid medium contained within said interior space;

movable indicator means disposed within said interior space and being movable therein in said fluid medium;

said fluid medium being of a character that said interior wall portion of said interior space and said movable indicator means are visible therethrough when viewed through said transparent surface area; and said elongated means being cooperable with said movable indicator means to guide said movable indicator means longitudinally thereof substantially without restraining said movable indicator means against movement laterally thereof, whereby movement of said movable indicator means with respect to said elongated means assists a golfer in lining up a golf putter with both a golf ball and a desired path during a putting stroke.

11. The combination as set forth in claim 10 wherein said elongated means includes elongated groove means formed in said interior wall portion.

12. The combination as set forth in claim 11 wherein said movable indicator means is a spherical ball.

13. The combination as set forth in claim 12 wherein said groove means is a groove of approximately 1/32 in. maximum width.

14. The combination as set forth in claim 13 wherein said spherical ball is a ball of approximately ¼ in. diameter.

15. The combination as set forth in claim 10 additionally including transverse marker means extending on said interior wall transversely of said elongated means.

16. The combination as set forth in claim 10 wherein said interior wall portion is an upwardly facing wall and said movable indicator means is gravitationally supportable thereon when said putter club is disposed in its use position.

17. The combination as set forth in claim 10 wherein said elongated means is cooperable with said movable indicator means by gravitational interaction therebetween to guide said movable indicator means longitudinally thereof substantially without restraining said movable indicator means against movement laterally thereof during use of said putter club.

* * * * *